US006138634A

United States Patent [19]

Kusche et al.

[11] Patent Number: 6,138,634

[45] Date of Patent: Oct. 31, 2000

[54] OIL LUBRICATION SYSTEM FOR AN INTERNAL COMBUSTION ENGINE

[75] Inventors: David W. Kusche; Neil M. Andrasko, both of Oshkosh, Wis.

[73] Assignee: Brunswick Corporation, Lake Forest, Ill.

[21] Appl. No.: 09/371,996

[22] Filed: Aug. 11, 1999

Related U.S. Application Data

[63] Continuation of application No. 08/988,156, Dec. 10, 1997, Pat. No. 5,950,588.

[51] Int. Cl.[7] ..... F01M 11/00

[52] U.S. Cl. ..... 123/196 R; 123/196 W; 184/6.18

[58] Field of Search ..... 123/196 R, 196 W, 123/196 CP, 196 M; 184/6.5, 6.8, 6.18; 440/900

[56] References Cited

U.S. PATENT DOCUMENTS

| | | | |
|---|---|---|---|
| 4,493,661 | 1/1985 | Iwai | 440/77 |
| 4,926,814 | 5/1990 | Bonde | 123/196 W |
| 5,570,662 | 11/1996 | Niemchick et al. | 123/74 AE |
| 5,755,194 | 5/1998 | Moorman et al. | 123/196 W |
| 5,950,588 | 9/1999 | Kusche et al. | 123/196 R |
| 5,960,764 | 10/1999 | Araki | 123/196 R |
| 5,975,042 | 11/1999 | Aizawa et al. | 123/196 M |
| 6,058,900 | 5/2000 | Kusche et al. | 123/196 CP |
| 6,067,952 | 5/2000 | Andrasko et al. | 123/196 R |

*Primary Examiner*—Tony M. Arganbright
*Assistant Examiner*—Hai Huynh
*Attorney, Agent, or Firm*—Andrus, Sceales, Starke & Sawall, LLP

[57] ABSTRACT

An oil lubrication system for a marine outboard motor including an internal combustion engine. The oil lubrication system includes a series of oil passageways within the cylinder block of the internal combustion engine. The oil passageways are configured such that each cylinder in the internal combustion engine is supplied by its own oil passageway. Each of the oil passageways terminate in an outlet opening. The outlet opening is positioned within the cylinder block such that oil exiting the outlet opening is directed by the force of gravity into contact with a moving component of the internal combustion engine. As the internal components of the internal combustion engine move, oil contacting the components is physically distributed into contact with the bearings.

7 Claims, 5 Drawing Sheets

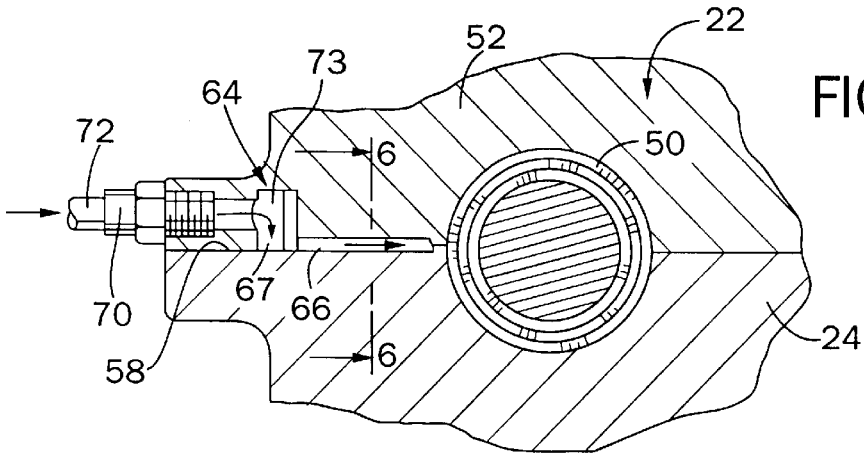
FIG. 4
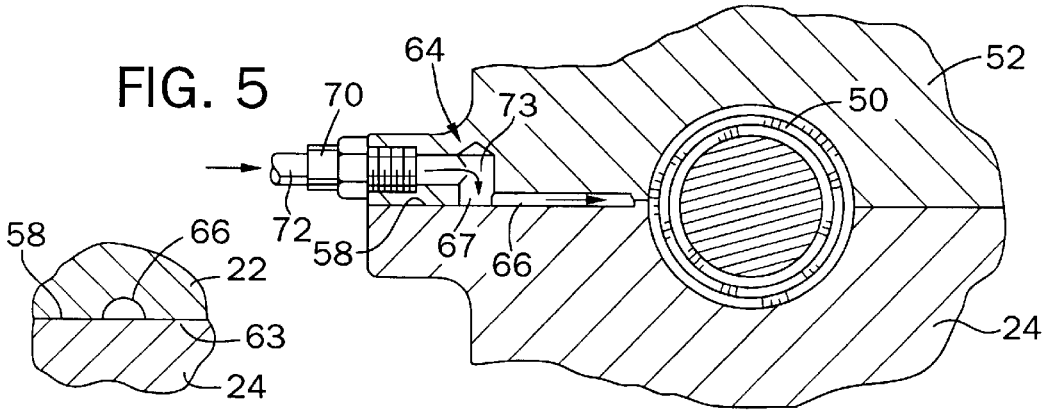
FIG. 5
FIG. 6
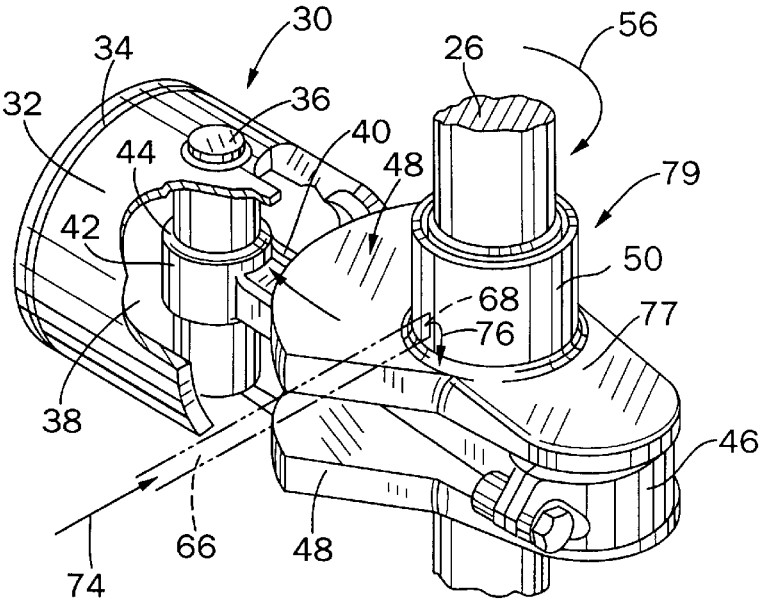
FIG. 7

OIL LUBRICATION SYSTEM FOR AN INTERNAL COMBUSTION ENGINE

CROSS REFERENCE TO RELATED APPLICATION

This application is a continuation of U.S. application Ser. No. 08/988,156, filed Dec. 10, 1997, now U.S. Pat. No. 5,950,588.

BACKGROUND OF THE INVENTION

The present invention relates to an oil distribution system for an internal combustion engine. More specifically, the invention relates to an oil distribution system for a direct fuel injected (DFI) internal combustion engine that deposits oil in specific locations such that the reciprocating movement of the internal engine components distributes the oil.

In most fuel injected engines, the reciprocating movement of the pistons creates a vacuum inside the crankcase that draws air into the crankcase through a reed valve assembly. The fuel required for combustion is injected in a fine mist into the air flowing into the crankcase. In these engines, lubricating oil is combined with the fuel upstream from the reed valve assembly. The oil/fuel mixture forms a fine mist that is distributed into the crankcase under pressure. As each of the engine pistons moves in its cylinder, the piston creates a pressure that pushes the fine mist from the crankcase into the combustion chamber, where a spark plug ignites the fuel to power the engine. Since the lubricating oil is distributed along with the fuel, the oil/fuel mixture in the crankcase coats the crank shaft, the connecting rods, the underside of the piston heads and the other internal engine components that are in communication with the crankcase to provide adequate lubrication for the entire engine, particularly the bearings joining each connecting rod to one of the pistons and the crankshaft. This type of oil lubrication system is well known and has been used for many years to provide adequate lubrication for an internal combustion engine.

Recently, internal combustion engines have been developed incorporating direct fuel injection (DFI). In a DFI engine, fuel is introduced along with high pressure air directly into the combustion chamber of each cylinder after the exhaust port closes. The development of DFI engines has been driven by the need to meet ever increasing pollution standards, since a DFI system dramatically reduces the amount of unburned fuel entering the exhaust system and eventually draining into the water, in marine applications. Specifically, the underlying principle of introducing fuel directly into the combustion chamber greatly reduces the amount of pollution generated by a DFI engine, since a greater percentage of the fuel introduced into the combustion chamber is burned such that little or no unburned fuel escapes through the exhaust ports during each stroke of the engine. However, since fuel is no longer introduced into the crankcase under pressure, lubricating oil can no longer be introduced into the crankcase along with the fuel in a fine mist. Thus, problems arise in providing adequate lubrication for the rapidly moving internal engine components in a DFI engine.

In currently available DFI engines, oil is typically introduced along with air into the crankcase at a location downstream from the reed valve assembly. In this type of configuration, an oil pump distributes the oil in the air in an attempt to provide lubrication for the engine components, including the bearings between the connecting rods, the crankshaft, and the pistons. The lubricating oil is not efficiently dispersed within the engine block to provide the required amount of lubrication for the internal engine components.

In addition, when a DFI engine is used in a marine outboard motor, the engine block is typically mounted such that the crankshaft is oriented along a vertical axis and the pistons reciprocate in a generally horizontal plane. When lubricating oil is introduced into the crankcase downstream from the reed valve assembly, the oil has a tendency to be drawn by gravity toward the bottom of the crankcase. Thus, only a relatively small amount of oil contacts the wrist pin between the connecting rod and the piston head. Additionally, the oil lubrication system in a conventional DFI engine oftentimes provides inadequate lubrication for the bearings between the connecting rod and the crankshaft.

Therefore, it can be appreciated that an improved oil distribution system for an internal combustion engine that provides adequate distribution of oil on all of the internal engine components would be a desirable improvement. Specifically, an oil distribution system that can be used on a DFI engine to efficiently distribute oil in the required locations would be particularly desirable.

BRIEF SUMMARY OF THE INVENTION

The present invention is an oil lubrication system for an internal combustion engine that directly applies oil to the rapidly moving internal engine components. The oil distribution system of the present invention can be utilized on a variety of engine configurations, including an in-line engine or an engine having a V configuration.

An internal combustion engine incorporating the oil distribution system of the present invention includes a cylinder block that includes and defines a plurality of engine cylinders. Each of the engine cylinders includes a piston that is reciprocally movable within the cylinder. Each of the pistons is coupled to a rotatable crankshaft by a connecting rod. The connecting rods are joined to the crankshaft, such that through the connecting rod, the reciprocating movement of the pistons is converted into the rotational movement of the crankshaft.

The oil distribution system of the present invention includes a plurality of oil passageways, each of which terminates in an outlet opening. The outlet opening of each oil passageway is positioned such that the oil within the oil passageway exits the outlet opening and comes into direct contact with a portion of the crankshaft assembly. Since the crankshaft assembly is rotating at a high rate of speed, any oil contacting the crankshaft assembly is thrown off of the crankshaft assembly and into contact with the other internal engine components near the crankshaft assembly. By positioning the outlet openings at optimum positions with respect to the crankshaft assembly, the crankshaft assembly can be used to distribute the oil within the internal combustion engine to lubricate the bearings between the connecting rods and either the pistons or the crankshaft.

The crankshaft of the invention is positioned to rotate about a vertical axis, and each of the outlet openings is positioned above a portion of the crankshaft assembly, such that oil exiting the outlet openings falls onto the crankshaft assembly. In this manner, the rotating crankshaft assembly distributes oil within the internal combustion engine to lubricate the bearings as required.

In the first embodiment of the invention, the crankshaft assembly includes a plurality of counterweights that rotate within a plurality of internal cavities defined by the cylinder block. Each of the oil passageways includes an oil channel that terminates in an outlet opening. The outlet openings are positioned such that oil falls into the internal cavities and onto the rotating counterweights, such that the centrifugal force created by the rotating counterweights throws the oil outward into contact with the underside of each piston.

In the second embodiment of the invention, each oil passageway terminates in an outlet opening in the top wall in one of the cylinders. The oil exiting the outlet opening in the second embodiment falls directly into contact with one of the connecting rods, such that the motion of the connecting rods distributes the oil into contact with the pistons and the crankshaft.

In both the first and second embodiment of the invention, lubricating oil is applied directly onto the rapidly moving internal engine components such that the movement of the engine components distributes the oil. A fluorescent dye is used to determine the optimum position for the outlet opening in order to maximize the efficiency of the oil lubrication system.

Other objects and advantages of the invention will appear in the course of the following description.

BRIEF DESCRIPTION OF THE SEVERAL VIEWS OF THE DRAWINGS

The drawings illustrate the best mode presently contemplated of carrying out the invention.

In the drawings:

FIG. 4 is a partial sectional view taken along line 4—4 of FIG. 3 showing one of the oil passageways;

FIG. 5 is a partial sectional view taken along line 5—5 of FIG. 3 showing one of the oil passageways;

FIG. 6 is a partial sectional view taken along line 6—6 of FIG. 4 showing one of the oil channels;

FIG. 7 is a partial perspective view showing the placement of oil on the engine components in accordance with the present invention;

DETAILED DESCRIPTION OF THE INVENTION

Figure 1:
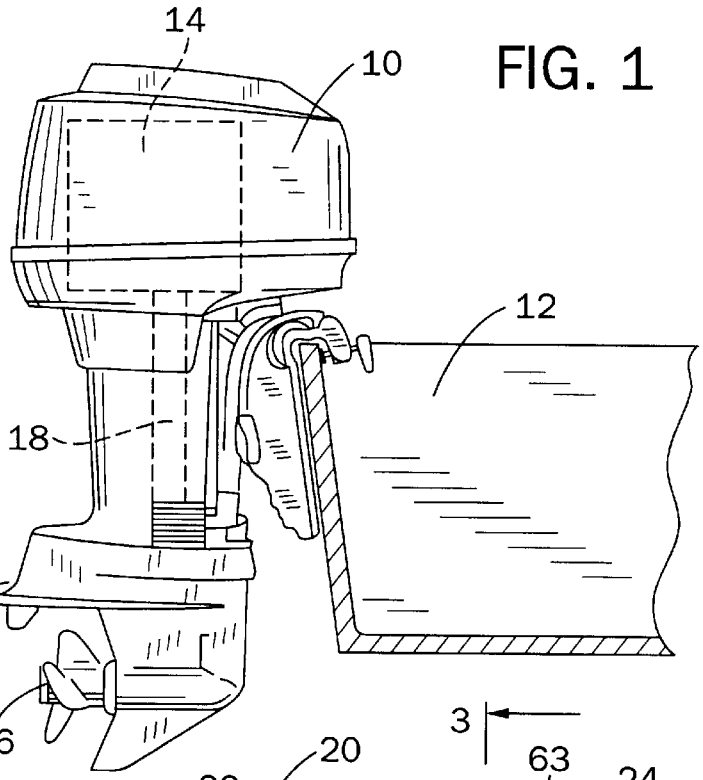
FIG. 1 is a side view of an outboard marine motor incorporating the oil distribution system of the present invention.

FIG. 1 shows a marine outboard motor 10 as conventionally mounted to a boat 12. The outboard motor 10 generally includes an internal combustion engine 14 that communicates with a submerged propeller 16 through a vertical drive train 18, such that the internal combustion engine 14 can provide the required force to rotate the propeller 16 and propel the boat 12.

Figure 2:
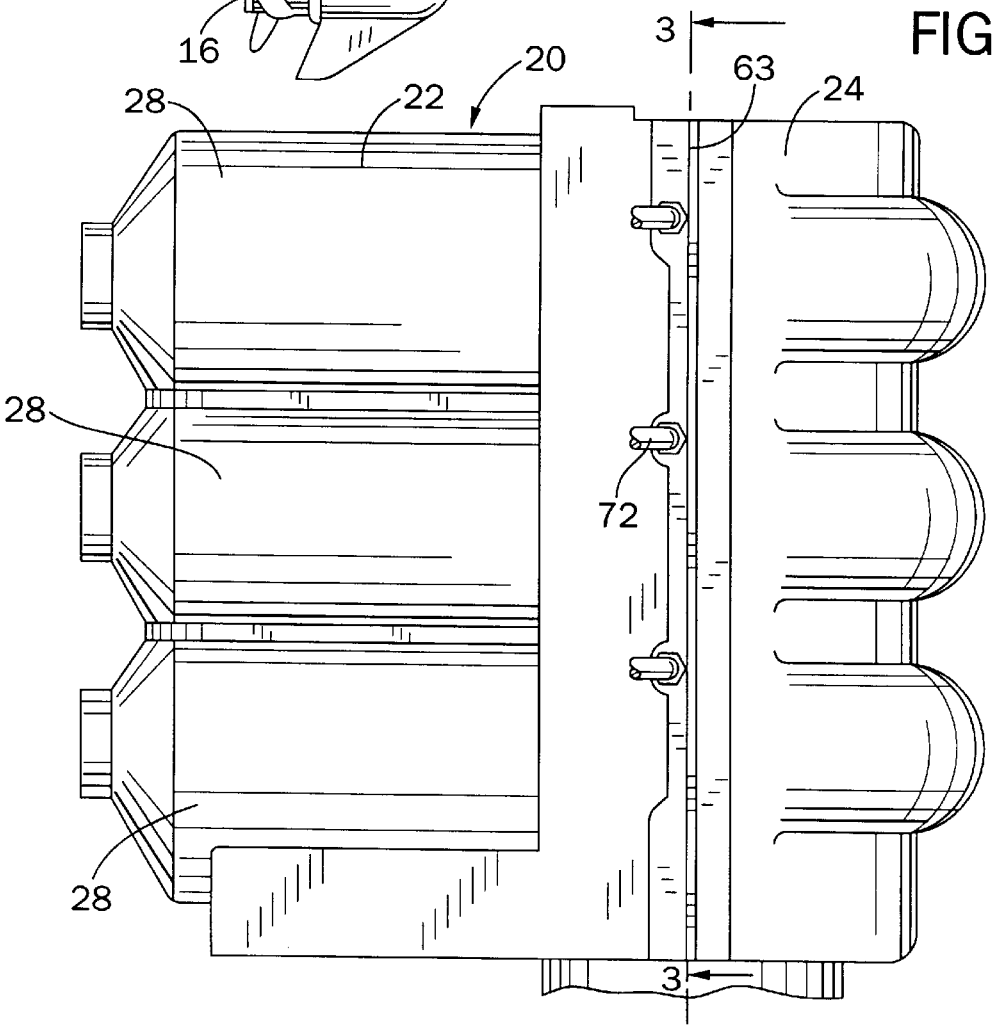
FIG. 2 is a side view of an internal combustion engine incorporating the oil distribution system of the present invention.
Figure 3:
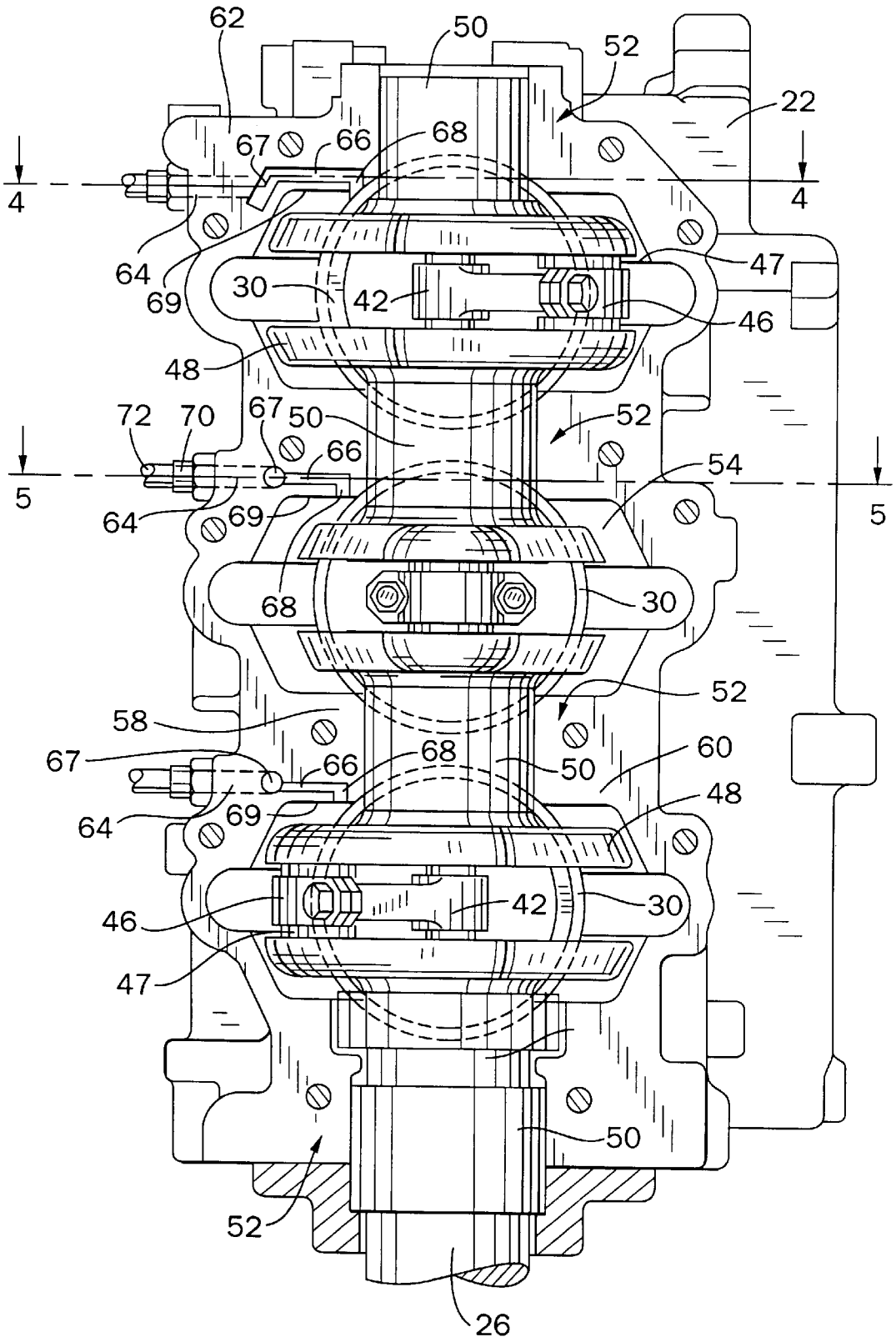
FIG. 3 is a sectional view taken along line 3—3 of FIG. 2 showing the oil passageways in relation to the crankshaft and the cylinder block.
Figure 8:
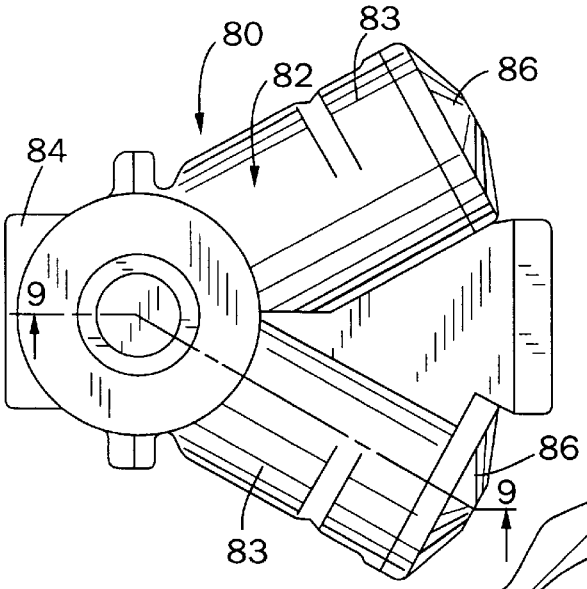
FIG. 8 is a top view of an internal combustion engine of the second embodiment of the invention.

Shown in FIGS. 2 and 3 is an internal combustion engine 20 of the first embodiment of the invention. The internal combustion engine 20 of the first embodiment is a three-cylinder, two-cycle direct fuel injected (DFI) engine. The engine 20 generally includes a cylinder block 22 and a crankcase cover 24 securely attached to the cylinder block 22. The engine 20 further includes a crankshaft 26 and a bank of cylinders 28. The engine 20 is mounted within the outboard motor 10 such that the crankshaft 26 extends along a vertical axis while the individual cylinders 28 each extend longitudinally along a generally horizontal axis. A piston 30 (FIG. 7) is reciprocally movable within each of the cylinders 28 defined by the cylinder block 22. Each of the pistons 30 reciprocates along a horizontal axis within its respective cylinder 28 in a conventional manner.

Referring now to FIG. 7, each of the pistons 30 generally includes a piston head 32 surrounded by a piston ring 34. The piston ring 34 interacts with the inside wall of the engine cylinder 28 to provide a seal between the piston head 32 and the engine cylinder 28. Each of the pistons 30 includes a wrist pin 36 extending across its generally hollow interior 38. A connecting rod 40 joins the piston 30 to the crankshaft 26. Specifically, a first end 42 of the connecting rod 40 surrounds the wrist pin 36. A first bearing assembly 44 is positioned between the first end 42 of the connecting rod 40 and the wrist pin 36 such that the wrist pin 36 can freely rotate with respect to the first end 42 of the connecting rod 40. A second end 46 of the connecting rod 40 surrounds a connecting portion 47 (FIG. 3) of the crankshaft 26. A second bearing assembly (not shown) is positioned between the second end 46 of the connecting rod 40 and the connecting portion 47 such that the crankshaft 26 can rotate with respect to the second end 46 of the connecting rod 40.

As shown in FIG. 7, the crankshaft 26 includes a pair of counterweights 48, each of which are positioned on opposite sides of the connecting rod 40. The counterweights 48 are sized to offset the inertial forces created by the reciprocating piston 30 in an effort to eliminate engine shaking in a conventional manner.

As can best be seen in FIG. 3, the crankshaft 26 is rotatably supported between the cylinder block 22 and the crankcase cover 24 by a series of main bearing assemblies 50. The crankshaft 26 passes through each of the main bearing assemblies 50 such that when the main bearing assemblies 50 are secured between the cylinder block 22 and the crankcase cover 24, the main bearing assemblies 50 allow the crankshaft 26 to freely rotate with respect to the stationary cylinder block 22 and crankcase cover 24. Each of the main bearing assemblies 50 is supported by a solid web portion 52 of the cylinder block 22. A series of corresponding web portions (not shown) are also formed on the crank case cover 24, such that each of the main bearing assemblies 50 is securely captured between the cylinder block 22 and the crankcase cover 24.

As shown in FIG. 3, the web portions 52 separate and define a series of internal cavities 54 that are sized to permit the rotating movement of the crankshaft 26, including the counterweights 48 and the connecting rods 40. A corresponding set of internal cavities (not shown) is also formed in the crankcase cover 24 such that the crankshaft 26 can freely rotate without the counterweights 48 or connecting rods 40 contacting either the cylinder block 22 or the crankcase cover 24.

Referring again to FIG. 3, each of the web portions 52 generally includes a first face surface 58 and a second face surface 60. Preferably, each of the face surfaces 58 and 60 is a generally flat surface that defines a portion of an attachment surface 62 of the cylinder block 22. The attachment surface 62 of the cylinder block 22 interacts with a similar flat attachment surface of the crankcase cover 24. A liquid gasket 63 (FIG. 2) is applied between the attachment surfaces of the cylinder block 22 and the crankcase cover 24 to form a fluid tight seal therebetween. The first face surface 58 of the web portion 52 is to the left of the crankshaft 26, while the second face surface 60 is on the right side of the crankshaft 26 when viewed as shown in FIG. 3.

In accordance with the invention, the cylinder block 22 includes a series of oil passageways 64. The oil passageways 64 are removed portions of the cylinder block 22 and each include an oil channel 66 formed in the first face surface 58 of the web portion 52 of the cylinder block 22. The oil channels 66 are depressions or removed grooves formed in the otherwise flat first face surface 58, as shown in FIG. 6. In the preferred embodiment of the invention, each oil channel 66 is generally semi-circular, although other configurations are contemplated as being within the scope of the invention.

As shown in FIG. 3, three oil channels 66 are formed in the cylinder block 22, each one corresponding to one of the three cylinders 28. Each of the oil channels 66 is generally perpendicular to the crankshaft 26 and extends from an inlet opening 67 spaced from the outer wall of the cylinder block 22 to an outlet opening 68. The outlet opening 68 is formed in the inside wall 69 of the respective web portion 52 such that each oil channel 66 can communicate with the internal cavity 54 through the respective outlet opening 68.

Each of the oil passageways 64 is connected to a supply of oil through a fitting 70 and an oil supply line 72. In the preferred embodiment of the invention, oil is supplied through the oil lines 72 by a conventional low pressure diaphragm-type oil pump. The manner in which oil is supplied to the fittings 70 could be accomplished by numerous oil pump arrangements. However, it is important to note that in the preferred embodiment of the invention, oil supplied through the oil lines 72 can be supplied at a low pressure, such as approximately 10 psi in the preferred embodiment.

Referring now to FIGS. 4 and 5, when oil is supplied through the oil lines 72 to each of the oil passageways 64, the oil flows through an internal bore 73 that communicates with the oil channel 66 through the inlet opening 67, such that oil flowing through the fitting 70 can reach the oil channel 66 and be distributed. As can be seen in FIGS. 4 and 5, the oil channel 66 extends inwardly toward the crankshaft 26 and terminates just before the main bearing assembly 50, such that a portion of the first face surface 58 is positioned between the outlet opening 68 (FIG. 3) and the bearing assembly 50. Although this position of the outlet opening 68 is shown in the preferred embodiment of the invention, it is understood that the outlet opening 68 could be moved along the first face surface 58 depending upon the engine configuration for which the oil lubrication system of the invention is required.

As is shown in phantom in FIG. 7, oil flowing in the direction of arrow 74 travels through the oil channel 66 until it reaches the outlet opening 68. Since the engine block 22 is typically mounted within the outboard motor 10 such that the crankshaft 26 extends along a vertical axis, oil reaching the outlet opening 68 falls in the direction shown by arrow 76 due to the force of gravity.

As oil exits the oil channel 66, as shown by arrow 76, the oil falls into the internal cavity 54 (FIG. 3) and into contact with the rotating counterweights 48. Since the crankshaft 26 and the counterweights 48 are rotating at a high speed in the clockwise direction (arrow 56) when viewed from above in FIG. 7, when enough oil builds up on the face surface 77 of the counterweight 48, the centrifugal force created by the high speed rotation of the crankshaft 26 forces the oil outward and off of the face surface 77. As the crankshaft 26 continues to rotate, oil falling on the counterweight 48 is immediately distributed outwardly toward the piston 30. As the oil is outwardly directed by the rotating counterweights 48, the oil comes into contact with the first bearing assembly 44 between the wrist pin 36 and the connecting rod 40. Additionally, as the crankshaft 26 rotates, oil exiting the outlet opening 68 directly coats the second bearing assembly between the crankshaft 26 and the connecting rod 40. In this manner, oil flowing through the oil passageway 64 and oil channel 66 is directly applied to the crankshaft assembly 79, including the crankshaft 26, the connecting rod 40, and the counterweight 48, such that the crankshaft assembly 79 can distribute the oil to lubricate the internal engine components.

As can be understood in FIG. 7, it is important that the oil channel 66 be formed in the first face surface 58 on the left side of the crankshaft 26, rather than the second face surface 60 on the right side of the crankshaft. If the oil channel 66 was formed in the second face surface 60, the clockwise rotating counterweights 48 would direct a majority of the oil in the opposite direction away from the pistons 30 and into the crankcase cover 24. In addition, it is extremely important that the location of the outlet opening 68 be specifically positioned such that oil (arrow 76) is directly applied to the counterweight 48 in an optimal manner. For example, if the outlet opening 68 were located a greater distance from the main bearing assembly 50, the oil may not optimally contact the rotating counterweights 48 and the bearings between the connecting rod 40 and the crankshaft 26.

During the design of the engine shown in FIGS. 2–7, a fluorescent dye was mixed with the oil to determine the optimum position of the outlet openings 68. In particular, a fluorescent dye called "fluoro-dye", available from Corrosion Consultants, was mixed with conventional engine oil at a ratio of approximately 10:1 and the engine was operated for a test period of approximately 15 seconds. After operating the engine for the test period, the crankshaft assembly 79 and the pistons 30 were removed and examined under black light. By examining the coating of oil including the fluorescent dye on the crankshaft 26 and pistons 30 under black light, the effectiveness of the outlet openings 68 position could be determined. This procedure was repeated numerous times until an optimal position of the outlet openings 68 was determined. Without using the fluorescent dye, determining the amount of oil coating the engine components was extremely difficult, if not impossible. Thus, the method of using the fluorescent dye to determine the optimum position of the outlet openings 68 allows each engine to be configured according to the specific design characteristics of the engine itself.

By using the oil distribution method described, engine oil can be directly applied through the oil channels 66 to the crankshaft assembly 79, including the crankshaft 26 and connecting rods 40, such that the movement of the counterweights 48 and the crankshaft 26 distributes oil into contact with the bearings positioned between the connecting rods 40, the pistons 30 and crankshaft 26. Thus, oil is directly applied to the engine components and the movement of the components themselves distributes the oil, unlike the conventional method of distributing oil in which the oil is distributed as a fine mist throughout the engine.

Figure 9:
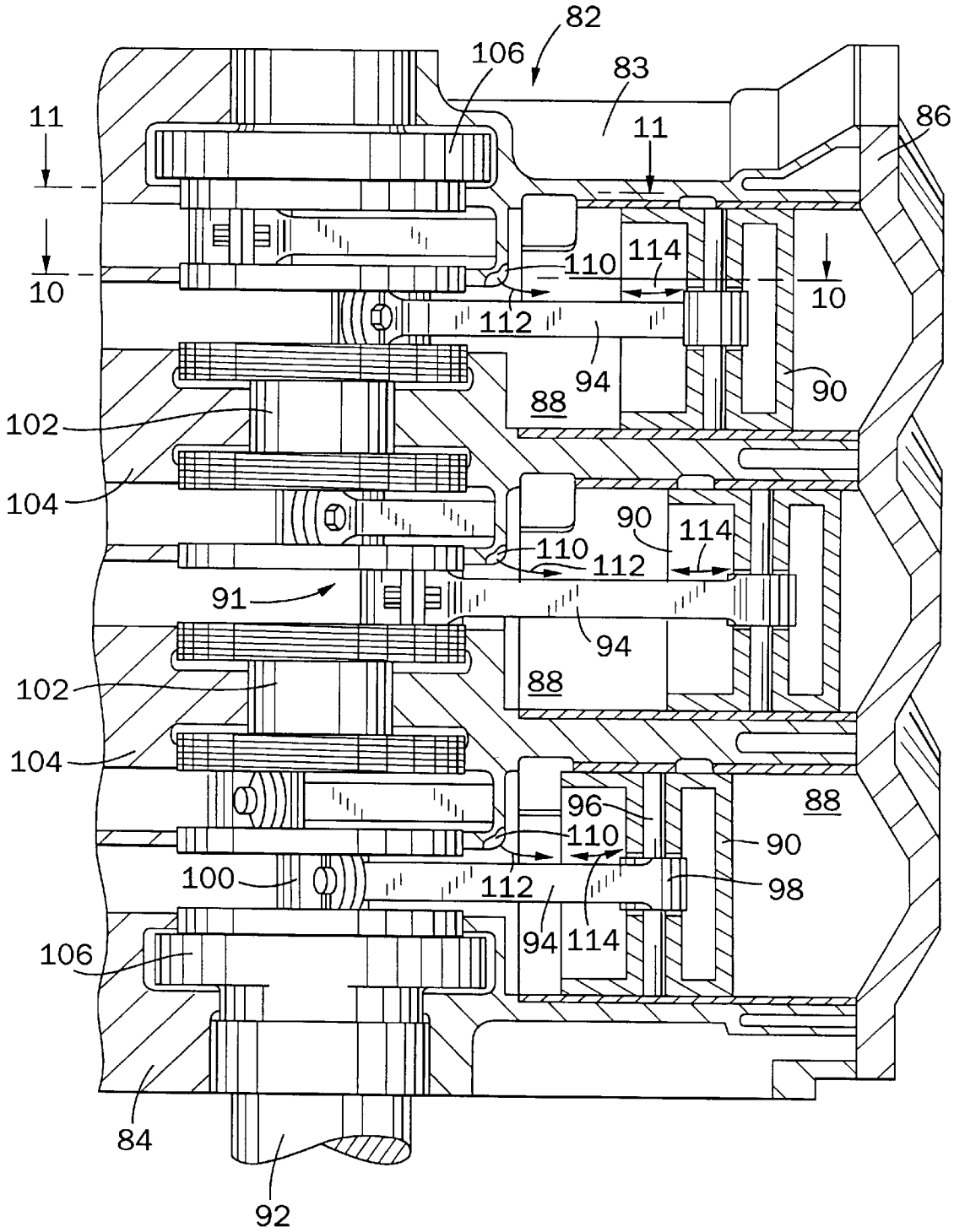
FIG. 9 is a partial sectional view taken along line 9—9 of FIG. 8 showing the oil passageways of the second embodiment of the invention in relation to the crankshaft and the cylinder block.

Shown in FIGS. 8–11 is a second embodiment of an internal combustion engine incorporating the oil lubrication system of the present invention. In contrast to the 3-cylinder, DFI engine 20 shown in FIGS. 2–7, the internal combustion engine 80 of the second embodiment is a six-cylinder DFI engine. In the six-cylinder internal combustion engine 80, the six cylinders are arranged in a V configuration as is clearly shown in FIG. 8. Generally, the engine 80 includes a cylinder block 82, a crankcase cover 84 and a pair of cylinder heads 86. The cylinder heads 86 define the top of each of the cylinders 88, as shown in FIG. 9. As is best shown in FIG. 9, each of the cylinders 88 includes a piston 90 joined to a crankshaft assembly 91, including a crankshaft 92 and a plurality of connecting rods 94. Each of the connecting rods 94 is connected to one of the pistons 90 by a wrist pin 96. Specifically, the first end 98 of the connecting rod 94 surrounds the wrist pin 96. A bearing assembly (not shown) is positioned between the first end 98 and the wrist pin 96 such that the first end 98 of the connecting rod 94 can rotate with respect to the wrist pin 96. A second end 100 of each connecting rod 94 is connected to the crankshaft 92 and surrounds a bearing assembly (not shown), such that the second end 100 of the connecting rod 94 can rotate with respect with the crankshaft 92.

The crankshaft 92 is rotatably supported by a pair of main bearing assemblies 102 that are received in the web portions 104 of the cylinder block 82. Thus, as in the first embodiment, the main bearing assemblies 102 allow the crankshaft 92 to rotate with respect to the cylinder block 82 and the crankcase cover 84. Unlike the first embodiment of the invention, the crankshaft assembly 91 includes a pair of counterweights 106 positioned on opposite axial ends of the crankshaft 92. Thus, the crankshaft assembly 91 of the second embodiment does not include counterweights which can be used to distribute oil into contact with the wrist pin 96 on each of the pistons 90. For this reason, the oil distribution system in the six-cylinder internal combustion engine 80 differs slightly from the oil distribution system in the three-cylinder internal combustion engine 20.

Figure 11:
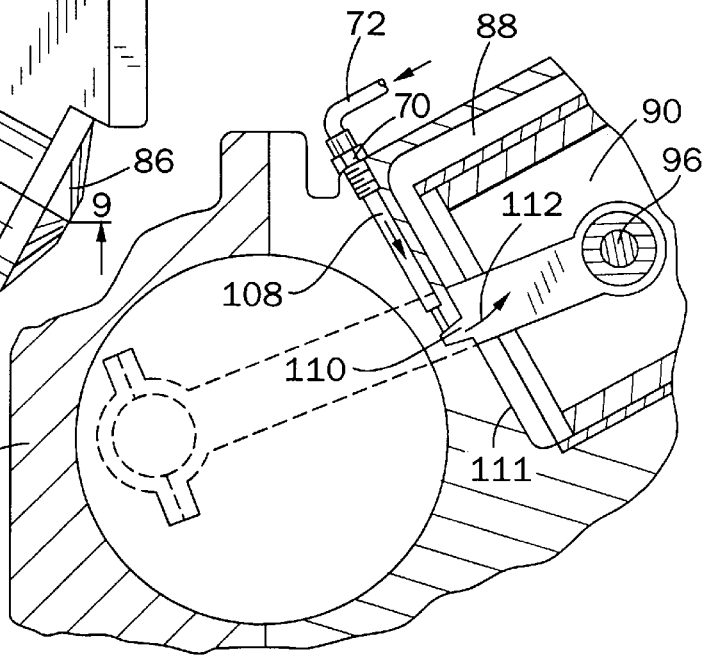
FIG. 11 is a partial sectional view taken alone line 11—11 of FIG. 9 showing one of the oil passageways of the second embodiment of the invention.
Figure 10:
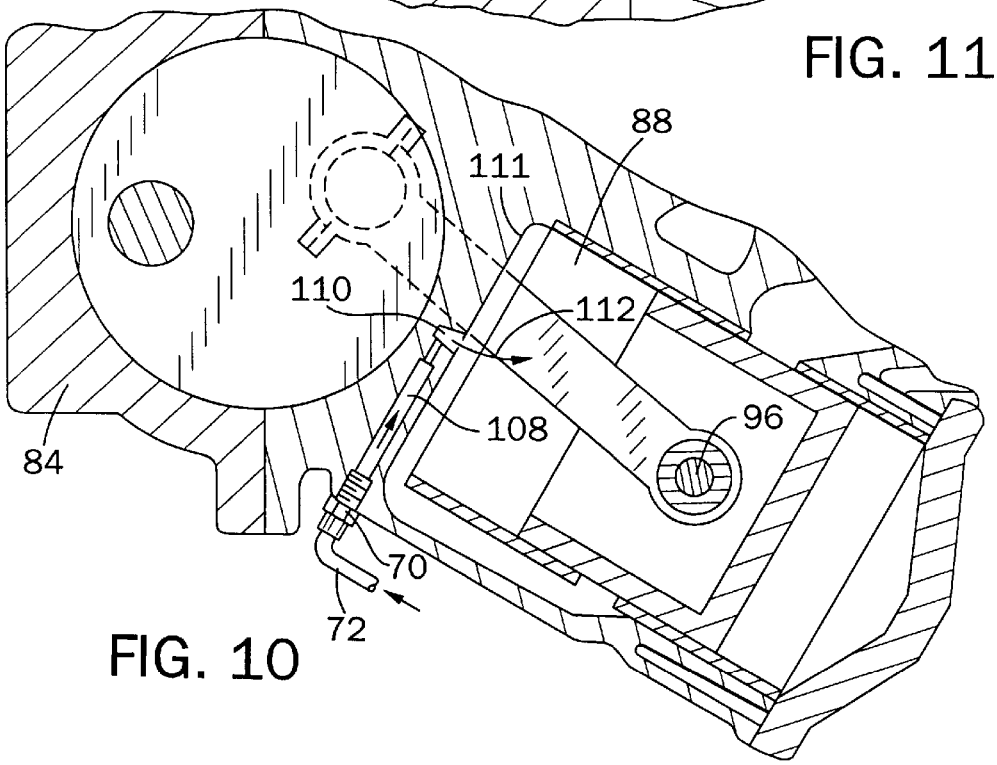
FIG. 10 is a partial sectional view taken along line 10—10 of FIG. 9 showing one of the oil passageways of the second embodiment of the invention.

As can best be seen in FIGS. 10 and 11, the cylinder block 82 includes a series of oil passageways 108 that extend between the exterior of the cylinder block 82 and the individual cylinders 88. Specifically, each of the oil passageways 108 includes a fitting 70 connected to the oil line 72, such that oil is supplied to each of the cylinders 88 from a low pressure oil pump. After the oil passes through the fitting 70, the oil enters the oil passageway 108 and travels to an outlet opening 110 formed in the bottom wall 111 of the cylinder.

As best shown in FIG. 9, each of the outlet openings 110 is positioned above the corresponding connecting rod 94 for each cylinder 88, such that oil exiting the outlet opening 110 falls downward onto the connecting rod 94 as shown by arrow 112. As with the engine 20 of the first embodiment, the engine 80 is mounted such that the crankshaft is vertically disposed as shown in FIG. 9. Thus, as oil exits the outlet opening 110 as shown by the arrow 112, the oil falls onto the connecting rod 94 due to the influence of gravity. Since each of the connecting rods 94 is reciprocating at a high rate of speed as shown by arrow 114, the oil that falls into contact with the connecting rod 94 is thrown throughout the cylinder 88 below the piston 90. In this manner, oil is distributed into contact with the bearings between the first end 98 of the connecting rod 94 and the wrist pin 96. Additionally, when the piston 90 is in its bottom dead center position, as shown in FIG. 11, the outlet opening 110 is relatively near the wrist pin 96, such that oil is distributed into contact with the wrist pin 96 to lubricate the bearing assembly position between the connecting rod 94 and the wrist pin 96.

As was discussed in the description of the three-cylinder internal combustion engine 20, the position of the outlet openings 110 is critical in the oil lubrication system. Specifically, each of the outlet openings 110 must be positioned above one of the connecting rods 94, such that oil is forced by gravity into contact with the connecting rod 94. When the oil contacts the connecting rod 94, the movement of the crankshaft assembly 91, specifically the connecting rods 94, acts to distribute the oil to lubricate the bearings between the connecting rod 94 and either the piston 90 or the crankshaft 92. In the same manner as the internal combustion engine 20, a fluorescent dye was used in determining the optimum position for the outlet openings 110. By injecting the fluorescent dye into the oil and allowing the engine to operate for a brief period of time, the dispersion of oil within the engine could be determined.

In accordance with the invention, an oil distribution system is described which uses the components within the engine, specifically the crankshaft and connecting rods, to disperse a coating of lubricating oil into contact with the bearings of the engine. In this manner, the engine components themselves are used to distribute the oil, without requiring a fine mist of oil to be entrained with the fuel supply. For this reason, the oil distribution system of the present invention is particularly desirable for use in a direct fuel injected (DFI) engine.

Various modes of carrying out the invention are contemplated as being within the scope of the following claims particularly pointing out and distinctly claiming the subject matter which regarded as invention.

We claim:

1. In an internal combustion engine having a plurality of cylinders formed in a cylinder block, a piston reciprocally movable within each cylinder, and a crankshaft assembly including a plurality of connecting rods joining the pistons to a crankshaft for converting the reciprocating movement of the pistons into rotational movement of the crankshaft, the crankshaft having a plurality of counterweights, the crankshaft extending vertically and rotating about a vertical axis, the improvement comprising:

a plurality of oil passageways formed in the cylinder block for distributing oil to lubricate the engine, each oil passageway terminating in an outlet opening, the outlet opening being positioned such that oil exits the outlet opening and falls by gravity in a direction parallel to the vertical extension of said crankshaft and onto said connecting rod and is distributed by the movement thereof, the piston reciprocating in the cylinder between a top dead center position and a bottom dead center position, wherein the outlet opening is exposed and uncovered in each of the top dead center and bottom dead center positions of the piston, such that oil exiting the outlet opening falls by gravity onto the connecting rod in each of the top dead center and bottom dead center positions of the piston, and wherein the outlet opening is horizontally spaced from the piston along the direction of the connecting rod when the piston is in the bottom dead center position and wherein the outlet opening is horizontally spaced from the counterweights along the direction of the connecting rod when the piston is in the top dead center position.

2. The improvement of claim 1 wherein the outlet opening is positioned such that oil exiting the outlet opening contacts the connecting rods such that the movement of the connecting rods distributes the oil within the internal combustion engine.

3. The improvement of claim 1 wherein oil is supplied to the oil passageways by a low pressure oil pump.

4. The improvement of claim 1 wherein oil is supplied to each of the cylinders by a separate oil passageway.

5. A method of distributing oil in an internal combustion engine having a plurality of cylinders formed in a cylinder block, a piston reciprocally movable within each cylinder, and a crankshaft assembly including a plurality of connecting rods joining the pistons to a crankshaft, the crankshaft having a plurality of counterweights, the crankshaft extending vertically and rotating about a vertical axis, the method comprising the steps of:

providing a plurality of oil passageways within the cylinder block, each oil passageway extending from the exterior of the cylinder block to an outlet opening positioned within the interior of the cylinder block;

positioning the outlet opening in a predetermined position relative to the connecting rod;

supplying oil to each of the oil passageways;

depositing oil from the outlet opening such that the oil falls by gravity in a direction parallel to the vertical extension of said crankshaft and onto the connecting rod; and distributing the oil in the internal combustion engine through the movement of the connecting rod, the piston reciprocating in the cylinder between a top dead center position and a bottom dead center position, and comprising positioning the outlet opening in a position which is exposed and uncovered in each of the top dead center and bottom dead center positions of the piston, such that oil exiting the outlet opening falls by gravity onto the connecting rod in each of the top dead center and bottom dead center positions of the piston, and positioning the outlet opening in a position horizontally spaced from the piston along the direction of the connecting rod when the piston is in the bottom dead center position and positioning the outlet opening in a position horizontally spaced from the counterweights along the direction of the connecting rod when the piston is in the top dead center position.

6. The method of claim 5 further comprising the step of testing the engine to determine the oil distribution within the cylinder block; and adjusting the position of the outlet openings to optimize the oil distribution within the engine.

7. The method of claim 6 wherein the step of testing the engine comprises:

mixing a fluorescent dye with the oil;

operating the internal combustion engine for a test period;

examining the crankshaft assembly and the pistons under black light to determine the oil distribution on the crankshaft assembly and the pistons; and adjusting the position of the outlet openings based on the distribution of the fluorescent dye on the crankshaft assembly and the pistons to optimize the oil distribution.

* * * * *